US006541440B2

(12) United States Patent
Heininger

(10) Patent No.: US 6,541,440 B2
(45) **Date of Patent: *Apr. 1, 2003**

(54) WASHING-AGENT ADDITIVE

(75) Inventor: Wolfgang Heininger, Moosburg (DE)

(73) Assignee: Süd-Chemie AG (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/051,573

(22) PCT Filed: Oct. 5, 1996

(86) PCT No.: PCT/EP96/04336

§ 371 (c)(1),
(2), (4) Date: Jun. 4, 1998

(87) PCT Pub. No.: WO97/13830

PCT Pub. Date: Apr. 17, 1997

(65) Prior Publication Data

US 2002/0039986 A1 Apr. 4, 2002

(30) Foreign Application Priority Data

Oct. 12, 1995 (DE) ..... 195 38 029

(51) Int. Cl.[7] ..... C11D 3/12; C11D 3/42

(52) U.S. Cl. ..... 510/444; 510/276; 510/394; 510/507; 8/648

(58) Field of Search ..... 510/444, 276, 510/567, 394; 423/326; 502/60, 62; 8/648

(56) References Cited

U.S. PATENT DOCUMENTS

| | | | | |
|---|---|---|---|---|
| 3,962,116 A | | 6/1976 | Bloching et al. | |
| 4,196,103 A | * | 4/1980 | Richter | 252/541 |
| 4,196,104 A | * | 4/1980 | Oguagha | 252/542 |
| 4,395,342 A | * | 7/1983 | Strauss | 252/8.75 |
| 4,399,049 A | | 8/1983 | Gray et al. | |
| 4,421,657 A | * | 12/1983 | Allen et al. | 252/8.6 |
| 4,488,972 A | * | 12/1984 | Weinstein et al. | 252/8.6 |
| 4,536,316 A | * | 8/1985 | Ramachandran | 252/171.11 |
| 4,698,167 A | * | 10/1987 | Burckett St. Laurent et al. | 252/8.8 |
| 4,737,306 A | | 4/1988 | Wichelhaus et al. | |
| 4,783,281 A | * | 11/1988 | Bishop | 252/135 |
| 5,030,377 A | | 7/1991 | Sone et al. | |
| 5,318,714 A | | 6/1994 | Markussen et al. | |
| 5,478,500 A | * | 12/1995 | Swift et al. | 510/350 |
| 5,478,502 A | * | 12/1995 | Swift | 510/350 |
| 5,691,294 A | * | 11/1997 | France et al. | 510/349 |

FOREIGN PATENT DOCUMENTS

| | | |
|---|---|---|
| DD | 220328 | 3/1985 |
| DE | 2856087 | 7/1980 |
| DE | 220325 | 3/1985 |
| DE | 220326 | 3/1985 |
| DE | 220327 | 3/1985 |
| FR | 2500475 | 8/1982 |
| GB | 1572815 | 8/1980 |
| WO | WO9114762 | 10/1991 |
| WO | WO A9513358 | 5/1995 |

OTHER PUBLICATIONS

Tricker, M. et al. "Novel Reactions of Hydrocarbon Complexes of Metal–Substituted Sheet Silicates. Thermal Dimerization of Trans–Stilbene", Nature, vol. 253, No. 5487, 1975, pp. 110–111 (Abstract).*

Habib, A. et al. "Catalytic Decomposition of Organic Peroxides by 4,4'–Diamino–Trans–Stilbene (D TS) /Montmorillonite Complex," J. Inclusion Phenom, vol. 3, No. 4, pp. 379–387, 1985 (Abstract).*

Endo, T. et al. "Optical Properties of Dyes Incorporated Into Clay," Stud. Surf. Sci. Catal., 60(Chem. Microporous Cryst.), 1991, pp. 189–196 (Abstract).*

Vol. 121:267512r: Photochemistry of Stilbene Adsorbed on Silica Gel and Nax Zeolite. A Diffuse Reflectance Laser Flash Photolysis Study. Lednev, et al. J. Phys. Chem., 1994, 98(44), 11444–51 (Eng.).

Vol. 113:8450u: Manufacture of Granulated Detergents. Cechnicki, et al. (Instytut Chemii Przemyslowej) Pol. PL 145,830, Nov. 30, 1988, Appl. 257,102; Dec. 24, 1985; 7 pp.

Vol. 98:1815889:High Bulk Density Carbonate–Zeolite Built Heavy Duty Nonionic Laudnry Detergent. Wixon, et al. (Colgate—Palmolive Co.) Can. CA 1,141,619 Feb. 22, 1983, Appl. 313,012, Oct. 10, 1978, 43 pp.

Vol. 108:58385u:Manufacture of High–Density Powder Detergent Compositions, Nagani, et al. (Lion Corp.) Jpn. Kokai Tokkyo Koho JP 62,236,897 Oct. 16, 1987, Appl. 86/80,917, Apr. 8, 1986, 8 pp.

* cited by examiner

*Primary Examiner*—Lorna M. Douyon
(74) *Attorney, Agent, or Firm*—Scott R. Cox

(57) ABSTRACT

A detergent in agglomerate form is described, characterized by the fact that it contains at least one swellable layer silicate and at least one optical brightener in intimate contact with each other.

11 Claims, No Drawings

WASHING-AGENT ADDITIVE

BACKGROUND OF INVENTION

The invention concerns a detergent additive based on swellable layer silicates.

Detergent auxiliaries to enhance whiteness are known from DD-220326, 220326, 220327 and 220328. These contain optical brighteners and nonswellable layer silicates, for example, the natural mineral magadiite. The use of aluminosilicates of limited swellability in detergents that also contain optical brighteners is also known from DE-A-35 26 405.

A trend toward higher bulk densities has been witnessed since the mid 80's in the development of detergents. The motive behind this is the possibility of reducing the use of excess volume-increasing fillers and saving packaging material. Another advantage is seen in the fact that smaller volume is essential in transport and marketing. The consumer has the advantage that detergent packages take up less room in the shopping cart.

An important step in the development of highly concentrated detergents with high bulk density is the omission of fillers or so-called extenders, like sodium sulfate.

DE-C-3 424 987 describes the production of detergent concentrates with high bulk density containing no sodium sulfate as an extender. In this case, a base powder is produced by spray drying, which contains the ordinary detergent ingredients, like surfactants, carboxymethylcellulose (CMC), sodium polyphosphate, zeolite A, water glass, optical brighteners, etc. The obtained base powder with low bulk density, which is free of sodium sulfate, is sprayed with an additional nonionic surfactant to increase the bulk density and mixed dry with a separately produced granulate with high bulk density. The optical brightener in this product is unprotected of contact, especially oxidation, by other detergent components.

Another serious shortcoming of highly concentrated detergents with high bulk density is the fact that the detergent components come in contact with each other in high individual concentrations without dilution with an extender. This was not the case in detergents with low bulk density that contained as much as 25% sodium sulfate. The active components of the detergent in detergent concentrates are tightly packed in high concentration. In an unfavorable case, the detergent components can react with each other during hydrolysis or oxidation, which can lead to an adverse effect on the function of the ingredients and the detergent.

Incorporation of optical brighteners in detergent concentrates with high bulk density poses a problem. In the production of detergents with low bulk density, the optical brightener was processed either in the sprayed product, or subsequently mixed as a powder into the tower product (sprayed product). If the optical brightener is not separated by a coating that forms during production, or by the presence of diluting, spatially separating and water-adsorbing extenders from the bleaching agents also contained in the detergent, like sodium perborate, but especially sodium percarbonate, the optical brighteners can be oxidized. The bleaching potential of the oxidized material is then no longer available for a later bleaching in the wash liquid. In addition, the oxidation product of the optical brightener can be colored yellow, so that the detergent, on the one hand, exhibits a yellow tint and, on the other hand, the yellow oxidation product of the brightener winds up essentially on the washed textiles, which adversely affects that aesthetic appearance, especially in white washing.

The formation of active oxygen in the detergent powder, which precedes oxidation of the optical brightener, is attributed to a reaction of the bleaching agent contained in the detergent powder, especially when percarbonate is the bleaching agent. In the presence of tetraacetylethylenediamine (TAED), peracetic acid is formed, from which active oxygen is liberated. This problem is described in M. Husslein et al., 36th International Conference 1994, WFK-Research Institute for Cleaning Technology e.V., page 82–85.

The problem was not serious in detergents with low bulk density that contained sodium sulfate because the water triggering the reaction could be bonded to sodium sulfate by formation of water of crystallization. However, the problem is very significant in detergents with high bulk density. A need therefore existed to protect optical brighteners, especially those of the stilbene type, from reaction with the active oxygen formed in the detergent powder.

Another problem accompanying the formulation of detergent concentrates is that the agglomerates with high bulk density do not dissolve quickly enough in the wash liquid and turn up in the washing liquid bottoms. Since sufficient mechanical stress on the agglomerates does not occur at that location, they only partially dissolve, so that the active components are partially deprived of detergent action.

Detergent agglomerates of high bulk density generally have poor dispersibility. This can be improved by adding dispersants and disintegrating agents, which swell on contact with water and break open or loosen the agglomerates, which leads to improved solubility and availability of the active components. It is described in an article of H. Führer, Seifen-Öle-Fette-Wachse, 18(1963), pages 561–562, that natural smectites that swell in water can be used as disintegrating agents in compacted detergent tablets.

The presence of a disintegrating agent that disintegrates the detergent agglomerates is also necessary to avoid so-called "brightener spotting". Brightener spotting develops from longer contact of undissolved, brightener-containing agglomerates with the washing. By direct contact of locally superconcentrated optical brightener, this is transferred in locally restricted fashion to the fabric at the contact site in undesired high concentrations. This is particularly visible in the presence of UV light in the form of light spots and adversely affects aesthetic appearance.

Detergent agglomerates must therefore contain disintegrating agents in order to be broken apart on contact with the washing liquid, though which the optical brightener is dissolved homogeneously in the washing liquid and direct contact of the detergent agglomerate with the washing is avoided.

If several detergents of different formulas are produced in a production installation for detergents, problems develop when brightener-containing and brightener-free detergents are produced in the same installation. Brightener-free formulated detergents are contaminated with residues of the optical brightener in installations in which a brightener-containing detergent had been produced beforehand. Even with thorough preliminary cleaning of the installation, this contamination cannot be fully ruled out.

A demand therefore exists for a detergent additive, in which the brightener component can be incorporated appropriately in the detergent while avoiding contact with the important parts of a detergent production unit without adversely affecting the function of the optical brightener.

SUMMARY OF THE INVENTION

The underlying task of the invention is to prepare a detergent additive in agglomerate form (granulate form), which contains at least one swellable layer silicate and an optical brightener that breaks down readily in water at good mechanical stability, and in which the optical brightener is homogeneously distributed and protected against oxidation by the oxidation agents contained in the detergent.

The object of the invention is a detergent additive in agglomerate form, characterized by the fact that it contains at least one swellable layer silicate and at least one optical brightener in intimate contact with each other.

DETAILED DESCRIPTION OF THE INVENTION

Owing to close contact of the optical brightener with the layer silicate, the optical brightener is protected reliably from oxidation processes during storage of the detergent and "brightener spotting" on the washing is avoided during use of the detergent. It is assumed that the optical brightener is intercalated at least partially between the layers of the layer silicate, since the initially present discrete brightener particles in the detergent additive have largely disappeared and the layer silicate particles appear homogeneously colored by the brightener under a fluorescence microscope.

The weight ratio of swellable layer silicate to optical brightener is preferably about 200-7:1, especially 100-10:1.

The swellable layer silicate is preferably a natural or clay mineral. The swellable clay mineral is preferably montmorillonite, beidellite, saponite or hectorite.

Montmorillonite can be used in the sodium or calcium form, or in the form of a calcium montmorillonite ion-exchanged with soda. Synthetically produced clay minerals from the aforementioned group can also be used. The layer silicate is preferably used in an amount from 90 to 99 wt. %.

Swellable layer silicates have the property of intercalating polar agents between the silicate lamellae during inner crystalline swelling, which manifests itself at high concentrations by an increase in layer spacing.

The optical brightener is preferably a stilbene derivative. However, benzoxazole, coumarin and pyrazoline derivatives can also be used. These products generally have an anionic dye group, for which reason it was surprising that they are intercalated between the negatively charged layers of the swellable layer silicate.

Appropriate optical brighteners include, for example,

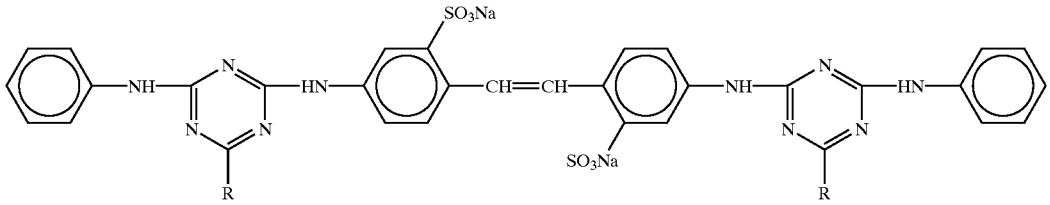

(a) Cyanuric acid chloride-diaminostilbene (CCDAS), in which R can have the following meanings:

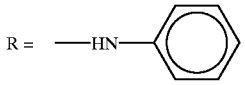

Type: Tetraaniline (Commercial name Tinopal® TAX-S from the Ciba-Geigy Company)

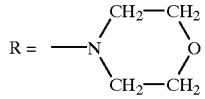

Type: Dimorpholine (Commercial name Tinopal® DMS-X h.c.)

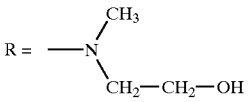

Type: Aminostilbene (Commercial name: Tinopal® 5 BMS-X)

(b)

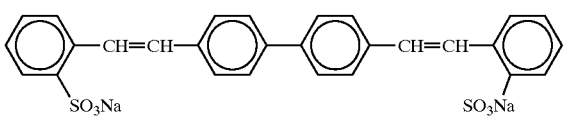

Commercial name: Tinopal® CBS-X

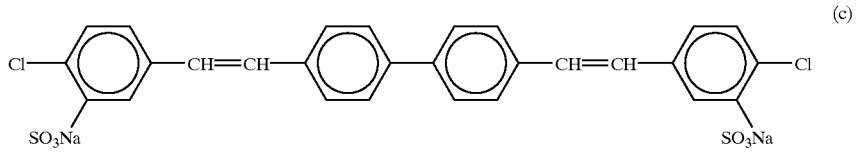

Commercial name: Tinopal® BLS-X

Since agglomerates from natural layer silicates and optical brighteners can have a beige, gray or yellow appearance, the agglomerate particles of the detergent additive are preferably enclosed with synthetic zeolite or a layered sodium silicate (preferably about 3 to 15 wt. %) so that the degree of whiteness of the agglomerate is improved. Additional preferred alternatives to conceal the natural color of the agglomerate consist of coloring with dyes common in detergents, especially pigment dyes, for example, Unidisperse® blue E—E (commercial product of the Ciba-Geigy Company) (preferably about 0.01 to 0.5 wt. %) or dye active substances in the additive (preferably about 0.3 to 5 wt. %), for example, the photobleaching agent Tinolux® BB[5] (commercial product of the Ciba Geigy Company).

The agglomerate preferably has a bulk density of more than about 700 g/L and is compatible, because of this high bulk density, with highly concentrated detergents with high density.

The object of the invention is also a process for production of the detergent additive just described in agglomerate form, characterized by the fact that the optical brightener(s) is (are) added as an aqueous slurry to the layer silicate(s).

The layer silicate(s) can be prepared (mixed with each other), for example, in an intense mixer, for example, in an Eirich mixer. The optical brightener(s) is (are) then sprayed (preferably as an aqueous dispersion) onto the powder components during agitation. An agglomerate is formed, which is screened and coated on the surface by addition of zeolite in powdered form to improve the degree of whiteness.

The obtained agglomerate is readily dispersible in water. The optical brightener is protected against oxidation and after dissolution of the agglomerate in the washing liquid is fully available. Because of the presence of the water-swellable layer silicate, no "brightener spotting" occurs. The agglomerate can be mixed into detergents produced in brightener-free production installations subsequently so that the installations are not contaminated with brightener.

The object of the invention is also a detergent containing the detergent additive just described, in addition to ordinary detergent components, like anionic and nonionic surfactants, builders, polymers (cobuilders), graying inhibitors, bleaching agents and bleach activators, enzymes, foam inhibitors, fragrances and/or dyes.

The preferred production process is explained below.

The optical brightener, or a mixture of different optical brighteners, is added during vigorous agitation to the powdered layer silicate as an aqueous dispersion (slurry).

If the optical brightener is added as an aqueous dispersion, the mixture agglomerates at a water content of about 20 to 30 wt. %, referred to the total mixture. After a mixing time of about 2 to 5 minutes, an agglomerate is obtained that is dried in an appropriate dryer, preferably in a fluidized bed dryer, to a residual water content of about 2 to 15 wt. %, preferably about 5 to 10 wt. %. The obtained agglomerate is screened with a sifter to a particle size of about 0.2 to 2.5 mm, preferably 0.5 to 1.7 mm. The <0.2 mm fraction is fed back to agglomeration. Coarse grains that form are crushed with a roll breaker and sent back to the sifter.

The screened agglomerate is introduced to a drum mixer (for example, a drum mixer from the Telschig Company), or a pan granulator. About 3 to 15 wt. % (preferably about 5 to 10 wt. %) of synthetic zeolite in fine-grained form is then added. The average particle size of this powder should preferably be <20 $\mu$m, especially about 3 to 10 $\mu$m. During mixing of the agglomerate with the powder, the latter is added to the outer surface of the agglomerate. Since the employed powder has a degree of whiteness of >90% (R 456, Elrepho), a white coating is formed around the agglomerate surface colored yellow by the brightener, so that the obtained agglomerate is white and cannot be distinguished from the color of the detergent.

The detergent additive produced according to the described process has the following additional advantages:

The bulk density is greater than 700 g/L, so that it is compatible with detergents of high bulk density. Owing to the swelling action of the layer silicate contained in the detergent additive, the agglomerates break down quickly in water. No brightener spotting is observed on the washing. The optical brightener is fully available in the detergent. The agglomerate is mechanically stable. The agglomerate can be subsequently mixed with the detergent, so that important parts of the detergent production installation are not contaminated with optical brightener.

The invention is explained by the following examples:

EXAMPLE 1

A detergent additive was produced according to the following formula:

| | | |
|---|---|---|
| A: | Bentonite (Laundrosil ® DGA, Süd Chemie AG) | 98 wt. % |
| B: | Optical brightener (Tinopal ® DMS-X h.c.) | 2 wt. % |

1960 g Laundrosil® DGA powder was introduced to an Eirich intensive mixer of type R02. 74.4 g of Tinopal® DMS slurry 36 (corresponding t 40 g Tinopal® DMS-X h.c.) was then added during intense agitation, followed by addition of 450 g of water. A light gray agglomerate was obtained, which was dried in a drying box to a residual moisture content of 10 wt. % water. The particle fraction from 0.4 to 1.4 mm was then screened.

5 wt. % of the detergent additive was mixed into a brightener-free test detergent. At a washing liquid ratio of 1:20 and a temperature of 30° C., this detergent was allowed to act without mechanical agitation for 1 minute on prebrightened cotton fabric. After rinsing, drying and ironing, spotting was evaluated visually as follows.

| | |
|---|---|
| In daylight: | very good |
| Under UV light: | very good |

10 wt. % of the detergent additive was mixed into an ECE test detergent that contained 7% Na-perborate-monohydrate and 3% TAED.

An equivalent amount of brightener, 0.2 wt. % Tinopal® DMS-X h.c., was introduced as comparison into an identical detergent via the slurry already during production of the sprayed product.

Both detergent samples were stored for eight weeks at 30° C. and 70% relative humidity in the open in a climatic chamber.

From the brightener content determined before and after the storage test by HPLC analysis, its loss in % was calculated. The results are shown in Table I.

TABLE I

| Brightener charge | Loss in % after 8 weeks |
|---|---|
| Via detergent additive | 23% |
| Via sprayed product | 55% |

The reduction in brightener content by oxidative breakdown is significantly lower during use of the detergent additive according to Example 1 in comparison with a detergent with the same overall composition, in which the brightener is contained in the sprayed product.

EXAMPLE 2

A detergent additive was produced according to the following formula:

| | | |
|---|---|---|
| A: | Bentonite (Laundrosil ® DGA, Süd Chemie AG) | 99 wt. % |
| B: | Optical brightener (Tinopal ® CBS-X) | 1 wt. % |

The production process corresponds to Example 1, in which the following weighed amounts were chosen:

1980 g Laundrosil® DGA powder 60 g Tinopal® CBS Slurry 33 (corresponding to 20 g Tinopal® CBS-S)

440 g water 90 parts by weight of a light beige agglomerate screened to 0.4 to 1.4 mm was then mixed with 10 parts by weight zeolite A and mixed in a pan granulator. The agglomerate was coated on the surface with the zeolite powder so that a white agglomerate was obtained.

The detergent additive was subjected as described in Example 1 to a spotting test on prebrightened cotton fabric. The evaluation was as follows:

| | |
|---|---|
| In daylight: | very good |
| Under UV light | acceptable |

10 wt. % of the detergent additive was mixed into the test detergent described in Example 1.

0.1% Tinopal® CBS-X was introduced in the comparative via the slurry into the sprayed product.

A storage stability test was then conducted as described in Example 1. The results are shown in Table II.

TABLE II

| Brightener charge | Loss in % after 8 weeks |
|---|---|
| Via detergent additive | 27% |
| Via sprayed product | 37% |

Breakdown of the brightener is more limited during use of the detergent additive than in a detergent of the same overall composition, in which the brightener is contained in the sprayed product.

What is claimed is:

1. A detergent additive for use with a detergent, wherein the detergent comprises bleaching agents and the detergent additive, wherein the detergent additive is in the form of non-spray dried agglomerate particles having a bulk density of at least about 700 g/L and, wherein the detergent additive consists essentially of a swellable layer silicate and an optical brightener dispersion and optionally soda, wherein the optical brightener dispersion is an aqueous dispersion of an optical brightener, wherein the optical brightener comprises a stilbene derivative, wherein the swellable layer silicate and the optical brightener are in intimate contact wherein the optical brightener is at least partially intercalated between layers of the layer silicate, wherein a weight ratio of the swellable layer silicate to the optical brightener is from about 100:1 to about 10:1 and wherein the agglomerate particles are coated with synthetic zeolite or treated with a dye or a colored active substance.

2. The detergent additive of claim 1 wherein the swellable layer silicate is selected from the group consisting of natural clay minerals and synthetic clay minerals.

3. The detergent additive of claim 2 wherein the clay mineral is selected from the group consisting of montmorillonite, beidellite, saponite and hectorite.

4. The detergent additive of claim 1 wherein the agglomerate particles are coated with the synthetic zeolite.

5. The detergent additive of claim 1 wherein the agglomerate particles are treated with the dye.

6. The detergent additive of claim 1 wherein the agglomerate particles are treated with the colored active substance which is a photobleaching agent.

7. A process of the production of detergent additives for use with a detergent, wherein the detergent comprises bleaching agents and the detergent additive, wherein the detergent additive is in the form of non-spray dried agglomerate particles having a bulk density of at least about 700 g/L, and consisting essentially of a swellable layer silicate and an optical brightener dispersion and optionally soda wherein the process comprises introducing an optical brightener dispersion, wherein the optical brightener dispersion is an aqueous dispersion of an optical brightener to the swellable layer silicate, intimately mixing the optical brightener dispersion with the swellable layered silicates and forming the detergent additive agglomerate particles from the mixture, wherein the optical brightener is a stilbene derivative and is at least partially intercalated between layers of the layer silicate and coating the agglomerate particles with a synthetic zeolite or treating with a dye or colored active substance.

8. The process of claim 7 wherein the agglomerate particles have a particle size of about 0.2 to about 2.5 mm. and a residual water content of about 2.0 to about 15.0 weight percent.

9. The process of claim 7 wherein the synthetic zeolite is from about 3.0 to about 15.0 weight percent, the dye is from about 0.01 to about 0.5 weight percent or the colored active substance is from about 0.3 to about 5.0 weight percent.

10. The process of claim 7 wherein the colored active substance is a photobleaching agent.

11. A detergent comprising the detergent additive of claim 1 and conventional detergent components selected from the group consisting of anionic and non-ionic surfactants, builders, polymer cobuilders, graying inhibitors, bleaching agents, bleaching activators, enzymes, foam inhibitors, fragrances and dyes.

* * * * *